United States Patent [19]

Binder et al.

[11] Patent Number: 4,477,944

[45] Date of Patent: Oct. 23, 1984

[54] APPARATUS AND METHOD FOR OPENING A FIBER BALE

[75] Inventors: Rolf Binder, Raeterschen; Daniel Hanselmann, Winterthur, both of Switzerland

[73] Assignee: Rieter Machine Works, Ltd., Winterthur, Switzerland

[21] Appl. No.: 398,185

[22] Filed: Jul. 14, 1982

[30] Foreign Application Priority Data

Jul. 15, 1981 [CH] Switzerland ..... 4624/81

[51] Int. Cl.[3] ..... D01G 13/00

[52] U.S. Cl. ..... 19/80 R

[58] Field of Search ..... 19/80 R, 81, 145.5

[56] References Cited

U.S. PATENT DOCUMENTS

| | | | |
|---|---|---|---|
| 3,736,624 | 6/1973 | Alt et al. | 19/80 R |
| 4,240,182 | 12/1980 | Leifeld et al. | 19/145.5 X |
| 4,281,437 | 8/1981 | Marx | 19/80 R |
| 4,297,767 | 11/1981 | Leifeld | 19/80 R |
| 4,357,737 | 11/1982 | Marx | 19/80 R |

FOREIGN PATENT DOCUMENTS

| | | | |
|---|---|---|---|
| 2100766 | 1/1983 | United Kingdom | 19/80 R |

*Primary Examiner*—Louis Rimrodt

*Attorney, Agent, or Firm*—Francis C. Hand

[57] ABSTRACT

A method and apparatus for opening fiber bales including a fiber removal element, compression means disposed upstream of said fiber removal element and advancing means near said compression means to advance the surface layer fiber material of a bale toward said fiber removal element.

13 Claims, 6 Drawing Figures

APPARATUS AND METHOD FOR OPENING A FIBER BALE

This invention relates to an apparatus and method for opening a fiber bale.

Heretofore, it has been known to open fiber bales, such as textile fiber bales, in various manners. For example, one known machine for opening fiber bales is marketed under the marked "Unifloc" and includes a fiber removal element which is movable to and fro over a roll of bales and which is able to penetrate into the surface layer of each bale to remove fiber flocks. This machine also includes a compression means for compressing the surface layer of a respective bale prior to removal of the fiber flocks by the fiber removal element. Generally, the fiber bales are positioned in a row on a floor area so that the removal element extracts flocks from the upper surface of the bales with the flocks then being pneumatically transported to other processing stations. However, depending upon the condition of the floor and/or the unevenness of the floor area, the compression means may not operate properly during the removal of the remnants of the fiber bales. For example, to the extent that the remnants are of relatively low height, for example of ten centimeters and less, the remnants may not be properly engaged by the compression means and may, therefore, be pushed along in front of the fiber removal element.

Accordingly, it is an object of the invention to insure an efficient opening of a fiber bale.

It is another object of the invention to provide a simple means for insuring that the remnants of a fiber bale can be readily opened.

It is another object of the inention to provide a simple technique for opening fiber bales in a relatively efficient manner.

Briefly, the invention provides an apparatus and method for opening a fiber bale.

The apparatus includes a fiber removal element, at least one compression means and at least one advancing means. The fiber removal element is mounted for to and fro movement at a predetermined speed over a given plane in order to penetrate into a surface of a fiber bale in the plane for removal of fiber therefrom. The compression means is disposed upstream of the fiber removal element relative to a direction of movement thereof in order to compress the surface of a bale in the plane prior to removal of the fiber. The advancing means is located near the compression means and is disposed to extend into the surface of a bale in order to move the bale towards the removal element.

The method comprises the steps of moving a fiber removal element at a predetermined speed to and fro over a surface of a bale to remove fiber flocks, compressing the surface layer of the bale upstream of the removal element relative to the direction of movement of the element and advancing the compressed surface of the bale toward the fiber removal element.

By advancing the compressed surface of the bale in the direction of the fiber removing element, not only are the bale remnants conveyed to the removal element but also the compression of the bale can be variably set.

The advancing means is able to extend into the surface of a bale with a given depth of penetration so that the fiber material can be grasped at a position on the conveying means at which breaking loose from the surface mass is prevented. Thus, the fiber material is more positively advanced than would be the case without the advancing means.

In one embodiment, the advancing means is formed of a rotatable shaft having a plurality of star-shaped discs fixedly mounted thereon while the compression means is in the form of a wall or plate which is upwardly inclined and which has slots through which the star-shaped discs of the advancing means project. In addition, the star-shaped discs are adjustably mounted relative to the wall in order to permit a variable depth of penetration into a bale. The wall may also be angularly adjustable so as to adjust the degree of compression.

In another embodiment, a pair of rotatable guide rolls are disposed upstream of the fiber removal element relative to a direction of movement with an endless conveying belt extending around the guide rolls for compressing the surface of a bale while moving the bale towards the fiber removal element. In this way, the compressing function and advancing function are combined. In addition, one of the rolls is movably mounted relative to the other so as to permit pivoting of the belt in angular relation to the surface of the bale.

These and other objects and advantages of the invention will become more apparent from the following detailed description taken in conjunction with the accompanying drawings wherein.

Figure 1:
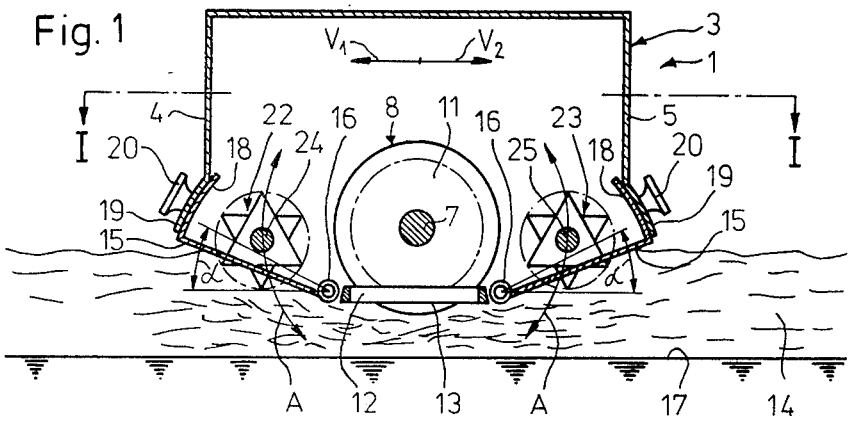
FIG. 1 illustrates a part schematic view taken on line III—III of FIG. 2.
Figure 2:
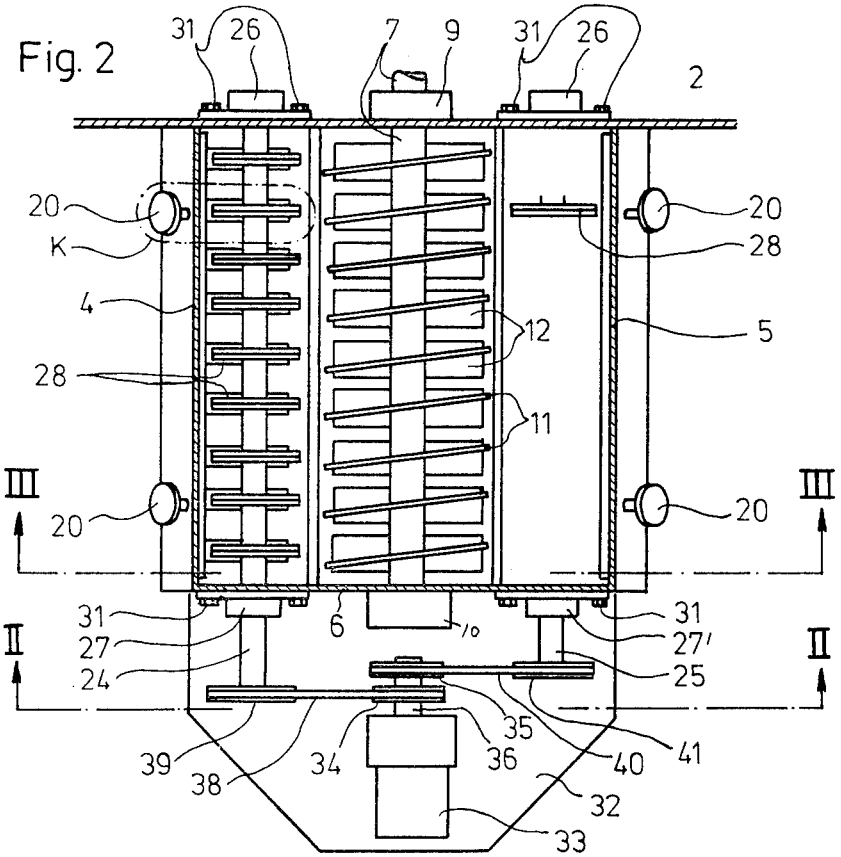
FIG. 2 illustrates a view taken on line I—I of FIG. 1.

Referring to FIGS. 1 and 2, the apparatus 1 for opening a row of fiber bales 14 is mounted on a machine frame 2 (FIG. 2) of a bale opening machine (not shown), for example, of the type sold by the assignee of this application under the trademark "Unifloc".

The apparatus 1 includes a machine housing 3 having side walls 4, 5 and a front wall 6. In addition, the apparatus 1 houses a fiber removal element in the form of a rotatable roll 8 having a shaft 7 which is rotatably supported on one side in a bearing 9 secured to the machine frame 2 and on the opposite side in a bearing 10 secured to the front wall 6. The shaft 7 of the fiber removal roll 8 is driven from a region of the machine which is not shown and which is separated from the machine housing 3 by the machine frame 2.

As indicated, the roll 8 has a plurality of toothed discs 11 (the teeth being indicated with dotted lines) which are fixedly secured to the shaft 7 in an oblique manner, for example, as swash plates. The toothed discs 11 are suitable for the removal of fiber flocks in both directions of rotation of the discs 11 and project through openings 12 of a grid 13 into the surface layers of the row of fiber bales 14.

In addition, the fiber removal roll 8, as well as the apparatus 1, is mounted for to and fro movement at a predetermined speed over a given plane so as to have the discs 11 penetrate into a surface of a fiber bale 14 in the plane for removal of fiber therefrom.

Referring to FIG. 1, the grid 13 is secured on one side to the machine frame 2 and on the opposite side to the front wall 6. In addition, a compression means is mounted on each side of the grid 13 upstream of the fiber removal roll 8 (depending upon the direction of movement of the roll 8) for compressing the surface layer of a bale. As indicated in FIGS. 1 and 2, each compression means is in the form of a wall or plate 15 which is pivotally mounted on a hinge joint 16 which is secured to one end of the grid 13. Each hinge joint 16 has a shaft which is securely let into the machine frame 2 at one end and the front wall 6 at the opposite end.

Figure 4:
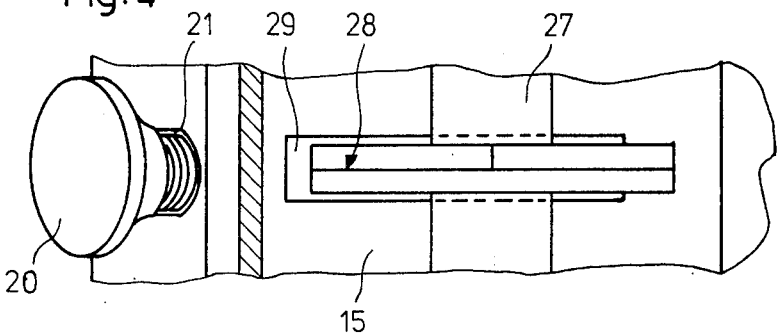
FIG. 4 illustrates an enlarged view of a detail K of FIG. 2.

Means are also provided for pivoting of each wall 15 over an angle $\alpha$ of from 10° to 30°. As indicated, the pivoting means is formed by a fixing plate 18 which is integral with one end of the wall 15 and a second fixing plate 19 which forms a part of a wall 4, 5 respectively. These fixing plates 18, 19 are curved relative to each other with the same radius of curvature so as to slide on one another during a pivoting movement. For example, the plate 18 is curved in a convex shape while the plate 19 is in a concave shape. In addition, the plates 18, 19 are pressed against each other by a pair of screws 20. In this regard, each fixing plate 18 is provided with screw holes (not shown) for taking up the screws 20. In order to permit a pivoting movement of the walls 15, the plates 19 are provided with slots 21 (see FIG. 4) through which each screw 20 may pass.

Of note, when the angle $\alpha$ is 0°, the walls 15 would be parallel to a floor 17.

Referring to FIGS. 1 and 2, the apparatus 1 also includes a pair of advancing means, each one of which is located near a compression means to opposite sides of the fiber removal roll 8. Each advancing means includes a star roll 22, 23 having a rotatable shaft 24, 25 on which a plurality of star-shaped discs 28 are fixedly mounted. The shafts 24, 25 are respectively mounted via bearings 26, 26'; 27, 27' in the machine frame 2 and front wall 6. In addition, the discs 28 project through slots 29 which are provided in the walls 15 into a fiber bale surface layer which is to be compressed. As shown in FIG. 1, the advancing discs 28 are formed by two elements of equilateral triangular shape which are secured to one another.

Figure 3:
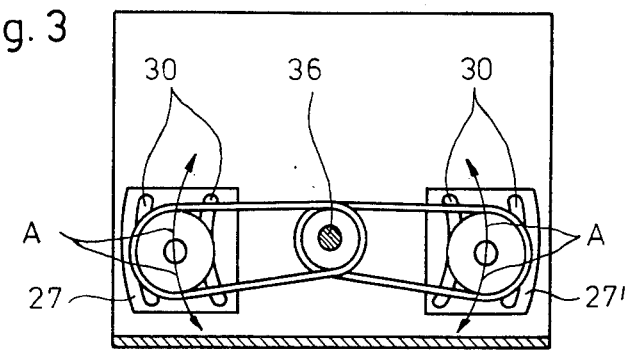
FIG. 3 illustrates a view taken on line II—II of FIG. 2.

Referring to FIG. 3, the star-shaped discs 28 are adjustably mounted relative to the respective walls 15 in order to permit a variable depth of penetration into a bale 15. To this end, the bearings 26, 26', 27, 27' are provided with slots 30 which function as guide slots for screws 31 which mount the bearings 26, 26', 27, 27' to the frame 2 and from the wall 6. Suitable screw holes (not shown) are also provided in a frame 2 and front wall 6 to receive the screws 31. Thus, the star rolls 22, 23 can be adjusted in the directions indicated by the arrows A in FIGS. 1 and 3. Suitable slots (not shown) are also disposed in the frame 2 and front wall 6 to permit corresponding movement of the shafts 24, 25.

The star rolls 22, 23 can be moved simultaneously with the walls 15 or can be moved relative to the walls 15, for example, to change the depth of penetration of the star rolls 22, 23 into the fiber bale surface layer.

Referring to FIG. 2, a means is provided for driving the shafts 24, 25 simultaneously. As shown, the drive means includes a gear motor 33 which is fixedly mounted on a support 32. The gear motor 33 has a rotatable shaft 36 on which a pair of chain wheels 34, 35 are fixedly mounted. One chain wheel 34 drives a chain 38 which connects with a chain wheel 39 which is fixedly mounted on the shaft 34 while the chain wheel 35 drives a chain 40 which drives a chain wheel 41 fixedly mounted on the shaft 25.

The rotational speed of the star rolls 22, 23 is chosen such that the tips of the toothed discs 11 maintains a peripheral speed which is at least 5% and, at most, 30% higher than the speed of movement of the removal apparatus 1. The peripheral speed as referred to as the advancing speed and a normal advancing speed is 20% higher than the speed of movement of the removal apparatus 1.

The direction of rotation of the star rolls 22, 23 is the same and changes in dependence upon the direction of movement such that the star roll which is upstream of the fiber removal roll 8, as viewed in the direction of movement, advances the compressed fiber bale surface layer positively, i.e., towards the removal roll 8.

Figure 5:
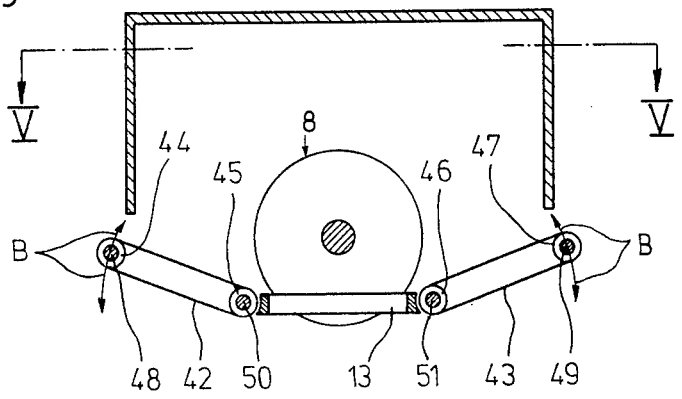
FIG. 5 illustrates a part schematic view of a modified apparatus according to the invention taken on line IV—IV of FIG. 6.
Figure 6:
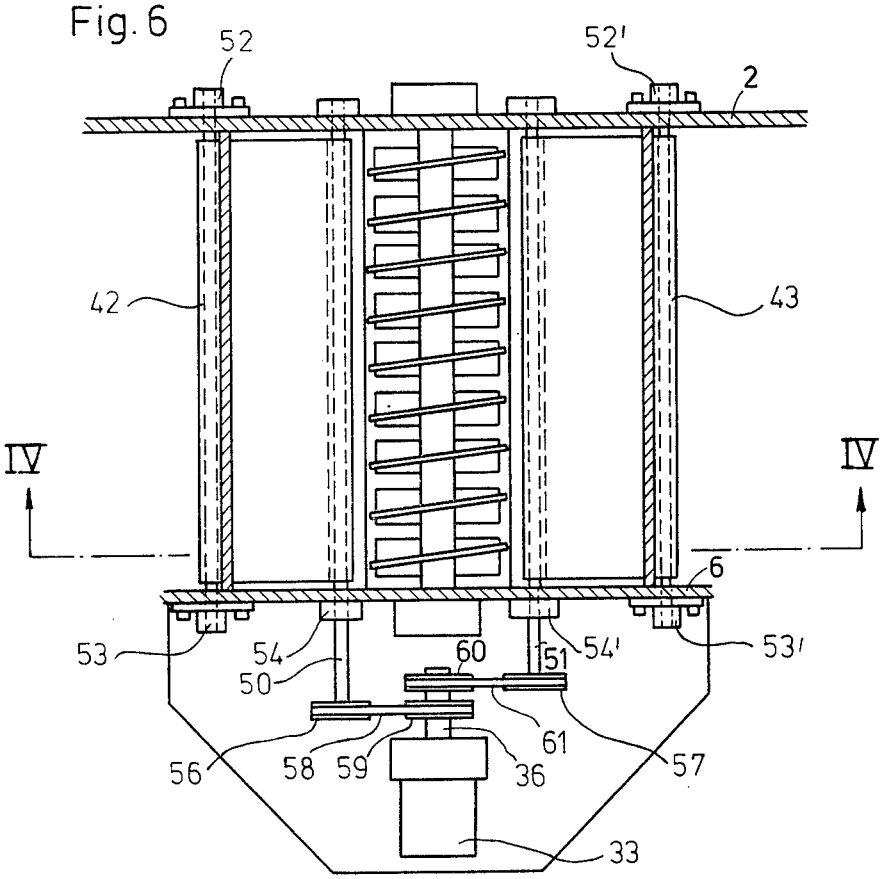
FIG. 6 illustrates a view taken on line V—V of FIG. 5.

Referring to FIGS. 5 and 6, wherein like reference characters indicate like parts as above, the fiber removal apparatus is constructed with a fiber removal roll 8, as above, which cooperates with a grid 13. In addition, a pair of rotatable guide rolls 44, 45; 46, 47 are disposed to opposite sides of the removal roll 8 and extend over at least the length of the roll 8. In addition, an endless conveying belt 42, 43 extends around each respective pair of guide rolls 44, 45; 46, 47 for compressing the surface of a bale while moving the bale towards the removal roll 8, depending upon the direction of movement of the apparatus 1. As indicated in FIG. 5, the outermost guide rolls 44, 47 are movably mounted relative to the other rolls 45, 46 in order to pivot the respective belts 42, 43 about the roll 45, 46 position adjacent to the removal roll 8. To this end, the outermost guide rolls 44, 47 are press fitted on respective axles 48, 49 which are each rotatably supported by bearings 52, 53; 52', 53' which are movably mounted relative to the machine frame 2 and front wall 6 in similar manner to the bearings 26, 27, 26', 27' described above. In addition, the guide rolls 45, 46 are fixedly secured to shafts 50, 51 which are rotatably supported via bearings 54, 55; 54', 55' in the frame 2 and front wall 6.

As indicated in FIG. 6, a gear motor 33 drives a pair of chain wheels 59, 60 which, in turn, drive chain wheels 56, 57 fixedly mounted on the shafts 50, 51 via chain belts 58, 61. As above, the speed of rotation of the shafts 50, 51 is chosen such that the surface speed of the conveying belts 42, 43 is between 5% and 35% higher than the speed of movement of the apparatus 1. A normal surface speed lies approximately 25% higher than the speed of movement of the removal apparatus 1.

Of note, the direction of rotation of the conveying belts 42, 43 is in the same sense and changes in dependence upon the direction of movement such that the conveying belt on the upstream side of the removal roll 8, as considered in the direction of movement, advances a fiber bale surface layer positively, i.e., towards the removal roll 8.

During operation, the fiber removal apparatus of either embodiment causes the surface layer of a bale which is to be opened to be compressed while being advanced toward the fiber removal element i.e. in opposition to the direction of movement of the fiber removal apparatus. In this way, during the to and fro movement of the apparatus 1, a positive motion of the bale towards the removal roll 8 occurs. Thus, even during removal of remnants of the fiber bales, i.e., during removal of a height of 10 centimeters and less, the remnants are advanced toward the removal roll. This negative advancing of the fiber bale surface, in essence, prevents individual remnants from being transported backwards instead of being carried along to the removal roll 8.

What is claimed is:

1. An apparatus for opening at least one fiber bale comprising a fiber removal element mounted for to and fro movement at a predetermined speed over a given plane to penetrate into a surface layer of a fiber bale in said plane for removal of fiber therefrom;

at least one compression means disposed upstream of said fiber removal element relative to a direction of movement thereof for compressing the surface layer of a bale in said plane; and at least one advancing means near said compression means for extending into the surface layer of a bale in said plane with a given depth of penetration to advance the fiber material thereof towards said fiber removal element.

2. An apparatus as set forth in claim 1 comprising a pair of said compression means and a pair of said advancing means, a respective one of said compression means and said advancing means being disposed on each side of said fiber removal element.

3. An apparatus as set forth in claim 2 wherein each said advancing means includes a rotatable shaft having a plurality of star-shaped discs fixedly mounted thereon, and which further includes a single drive shaft connected to each shaft of a respective advancing means for simultaneously driving said shafts.

4. An apparatus as set forth in claim 1 wherein said compression means includes a wall upwardly inclined relative to and passing through said plane to permit a lower end thereof to press into a surface layer of a bale in said plane, said wall having a plurality of slots therein, and wherein said advancing means includes a rotatable shaft having a plurality of star-shaped discs fixedly mounted thereon and projecting through slots for penetration into the surface layer of a bale.

5. An apparatus as set forth in claim 4 wherein said star-shaped discs are adjustably mounted relative to said wall to permit a variable depth of penetration into a surface layer of a bale.

6. An apparatus as set forth in claim 3 wherein said wall is angularly adjustable relative to said plane.

7. An apparatus as set forth in claim 1 wherein said fiber removal element is a rotatable roll having a shaft with a plurality of toothed discs.

8. An apparatus as set forth in claim 7 which further comprises a housing having said roll rotatably mounted therein, said compression means mounted therein and said advancing means mounted therein.

9. An apparatus for opening at least one fiber bale comprising a fiber removal element mounted for to and fro movement at a predetermined speed over a given plane to penetrate into a surface layer of a fiber bale in said plane for removal of fiber therefrom;

a pair of rotatable guide rolls disposed upstream of said fiber removal element relative to a direction of movement thereof and extending at least over the length of said fiber removal element; and an endless conveying belt extending around said guide rolls for compressing the surface layer of a bale while moving the fiber material of said surface layer towards said fiber removal element.

10. An apparatus as set forth in claim 9 wherein one of said rolls is movably mounted relative to the other of said rolls to pivot said belt about said other roll and wherein said other roll is positioned adjacent to said fiber movement element.

11. A method of opening a fiber bale comprising the steps of moving a fiber removal element at a predetermined speed to and fro over a surface of at least one fiber bale to remove fiber flocks therefrom;

compressing the surface layer of the bale upstream of the fiber removal element relative to a direction of movement thereof; and additionally advancing the compressed surface layer of the bale toward the fiber removal element in opposition to said direction of movement.

12. A method as set forth in claim 11 wherein the compressed surface is advanced at a speed of from 5% to 30% higher than said speed of the fiber removal element.

13. A method as set forth in claim 11 wherein the compression of the surface of the bale is variable.

* * * * *

UNITED STATES PATENT AND TRADEMARK OFFICE

CERTIFICATE OF CORRECTION

PATENT NO. : 4,477,944

DATED : October 23, 1984

INVENTOR(S) : Rolf Binder and Daniel Hanselmann

It is certified that error appears in the above-identified patent and that said Letters Patent is hereby corrected as shown below:

| Column | Line | Change From | To |
|---|---|---|---|
| 5 | 43 | "3" | --4-- |

Signed and Sealed this

*Second* Day of *July 1985*

[SEAL]

*Attest:*

DONALD J. QUIGG

*Attesting Officer* *Acting Commissioner of Patents and Trademarks*